US009352926B2

(12) United States Patent
Suzuki et al.

(10) Patent No.: US 9,352,926 B2
(45) Date of Patent: May 31, 2016

(54) SHEET STACKING APPARATUS, SHEET STORING APPARATUS, AND IMAGE FORMING APPARATUS

(71) Applicant: CANON KABUSHIKI KAISHA, Tokyo (JP)

(72) Inventors: Yohei Suzuki, Suntou-gun (JP); Masayoshi Fukatsu, Suntou-gun (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/278,237

(22) Filed: May 15, 2014

(65) Prior Publication Data

US 2014/0339765 A1 Nov. 20, 2014

(30) Foreign Application Priority Data

May 16, 2013 (JP) ..... 2013-104542

(51) Int. Cl.

| | |
|---|---|
| ***B65H 29/00*** | (2006.01) |
| ***B65H 31/24*** | (2006.01) |
| ***B65H 31/02*** | (2006.01) |
| ***B65H 31/30*** | (2006.01) |

(52) U.S. Cl.

CPC ..... *B65H 31/24* (2013.01); *B65H 31/02* (2013.01); *B65H 31/3081* (2013.01); *B65H 2301/4212* (2013.01); *B65H 2301/4213* (2013.01); *B65H 2405/332* (2013.01); *B65H 2801/06* (2013.01)

(58) Field of Classification Search

CPC ..... B65H 29/38; B65H 29/46; B65H 31/12; B65H 31/30; B65H 31/3081; B65H 2301/4226; B65H 2301/42266

USPC ..... 271/3.01, 3.02, 279, 287, 288, 289, 271/292, 293, 296, 297, 298, 303, 305, 207, 271/213, 224; 270/58.12, 58.14, 58.16, 270/58.17, 58.26

See application file for complete search history.

(56) References Cited

U.S. PATENT DOCUMENTS 4,691,914 A * 9/1987 Lawrence ..... 271/297

FOREIGN PATENT DOCUMENTS

| | | | |
|---|---|---|---|
| JP | 58-144050 | * | 8/1983 |
| JP | 11-199119 | A | 7/1999 |
| JP | 2008-156089 | A | 7/2008 |

* cited by examiner

*Primary Examiner* — Thomas Morrison

(74) *Attorney, Agent, or Firm* — Canon USA, Inc. IP Division

(57) ABSTRACT

A sheet stacking apparatus for stacking a sheet includes a plurality of sheet stacking units, an engaging member, and a first and second moving unit. The plurality of sheet stacking units are lapped over one another in a sheet thickness direction and each includes a stacking member that stacks a sheet thereon, a contact member that contacts an edge of a sheet stacked on the stacking member, the contact member being mounted to be movable to move the sheet stacked on the stacking member, and a contact engaged member mounted to be movable integrally with the contact member. The engaging member engages with the contact engaged member. The first moving unit moves the engaging member to engage the engaging member with the contact engaged member, and moves the contact member together with the contact engaged member. The second moving unit moves the engaging member in the sheet thickness direction.

26 Claims, 17 Drawing Sheets

SHEET STACKING APPARATUS, SHEET STORING APPARATUS, AND IMAGE FORMING APPARATUS

BACKGROUND OF THE INVENTION

1. Field of the Invention

The present invention relates to a sheet stacking apparatus that stacks sheets, a sheet storing apparatus that stores sheets, and an image forming apparatus.

2. Description of the Related Art

Some conventional image forming apparatuses, such as copying machines, are equipped with a post-processing apparatus that temporarily stacks a plurality of sheets on a tray, staples the sheets, and discharges the stapled sheets (refer to FIG. 2 in Japanese Patent Application Laid-Open No. 2008-156089). Also, Japanese Patent Application Laid-Open No. 11-199119 discusses an apparatus that moves up and down a bin on which a plurality of sheets are temporarily stacked, nips the plurality of sheets on the bin, and conveys the nipped sheets.

However, Japanese Patent Application Laid-Open No. 2008-156089 does not discuss an apparatus equipped with a plurality of trays for stacking. Also, even if the post-processing apparatus is equipped with a plurality of configurations discussed in Japanese Patent Application Laid-Open No. 2008-156089, the size of the apparatus may increase.

In the case of the configuration discussed in Japanese Patent Application Laid-Open No. 11-199119, since it is necessary to move up and down the bin, on which a plurality of sheets are stacked, a drive source strong enough to bear a high load is required.

SUMMARY OF THE INVENTION

The present invention is directed to a sheet stacking apparatus, a sheet storing apparatus, and an image forming apparatus, each of which is equipped with a plurality of sheet stacking units and is capable of discharging sheets without moving up and down the sheet stacking units.

According to an aspect of the present invention, a sheet stacking apparatus for stacking a sheet includes a plurality of sheet stacking units that are lapped over one another in a sheet thickness direction, each of the plurality of sheet stacking units including: a stacking member configured to stack a sheet thereon, a contact member configured to contact an edge of a sheet stacked on the stacking member, the contact member being mounted to be movable to move the sheet stacked on the stacking member, and a contact engaged member mounted to be movable integrally with the contact member, an engaging member configured to engage with the contact engaged member, a first moving unit configured to move the engaging member to engage the engaging member with the contact engaged member, and to move the contact member together with the contact engaged member, and a second moving unit configured to move the engaging member in the sheet thickness direction.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 8:
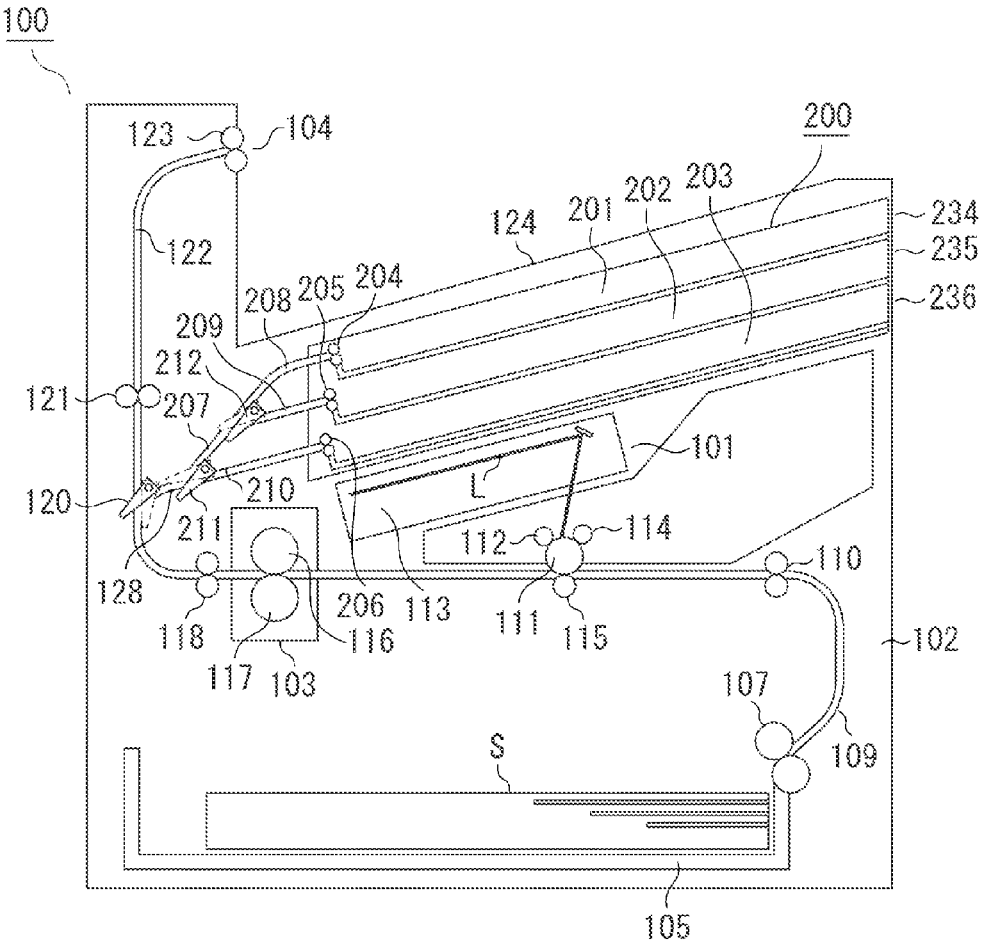
FIG. 8 is a sectional view illustrating a configuration of the image forming apparatus according to the first exemplary embodiment.

FIG. 8 is a sectional view illustrating a configuration of an image forming apparatus 100 equipped with a sheet storing apparatus 200 according to a first exemplary embodiment of the present invention. As illustrated in FIG. 8, a main body of the image forming apparatus 100 (hereinafter referred to as an apparatus body 100) includes an image forming unit 101, a feeding unit 102, which feeds a sheet S to the image forming unit 101, a fixing unit 103, and a sheet discharging unit 104. The sheet storing apparatus 200, which temporarily stores a sheet S having an image formed thereon, is attached to the apparatus body 100.

The image forming unit 101 includes a photosensitive drum 111, which rotates clockwise as viewed in FIG. 8, an exposure device 113, and a charging roller 112, a developing device 114, and a transfer roller 115, which are arranged almost in turn along the rotational direction of the photosensitive drum 111. The image forming unit 101 uses such process units to form a toner image on the sheet S with an electrophotographic image forming process.

The feeding unit 102, which feeds a sheet S, includes a feeding cassette 105, in which sheets S to be image-formed are stored, a feeding roller 107, a conveyance guide 109, and a registration roller 110.

The fixing unit 103 includes a fixing roller 116, a pressure roller 117, which is caused to contact the fixing roller 116 from below, and a fixing discharging roller pair 118, and is configured to fix a toner image formed on the sheet S by the image forming unit 101.

The sheet discharging unit 104 includes a first switching member 120, a conveyance roller 121, a discharging guide 122, a discharging roller 123, and a discharging stacking member 124, which is formed on the top surface of the apparatus body 100.

The first switching member 120 can be switched by a central processing unit (CPU) 50 (illustrated in FIG. 11) between a position indicated with the solid line in FIG. 8 to direct the image-formed sheet S toward the sheet storing apparatus 200 and a discharging position indicated with the broken line to discharge the image-formed sheet S to the discharging stacking member 124.

Figure 11:
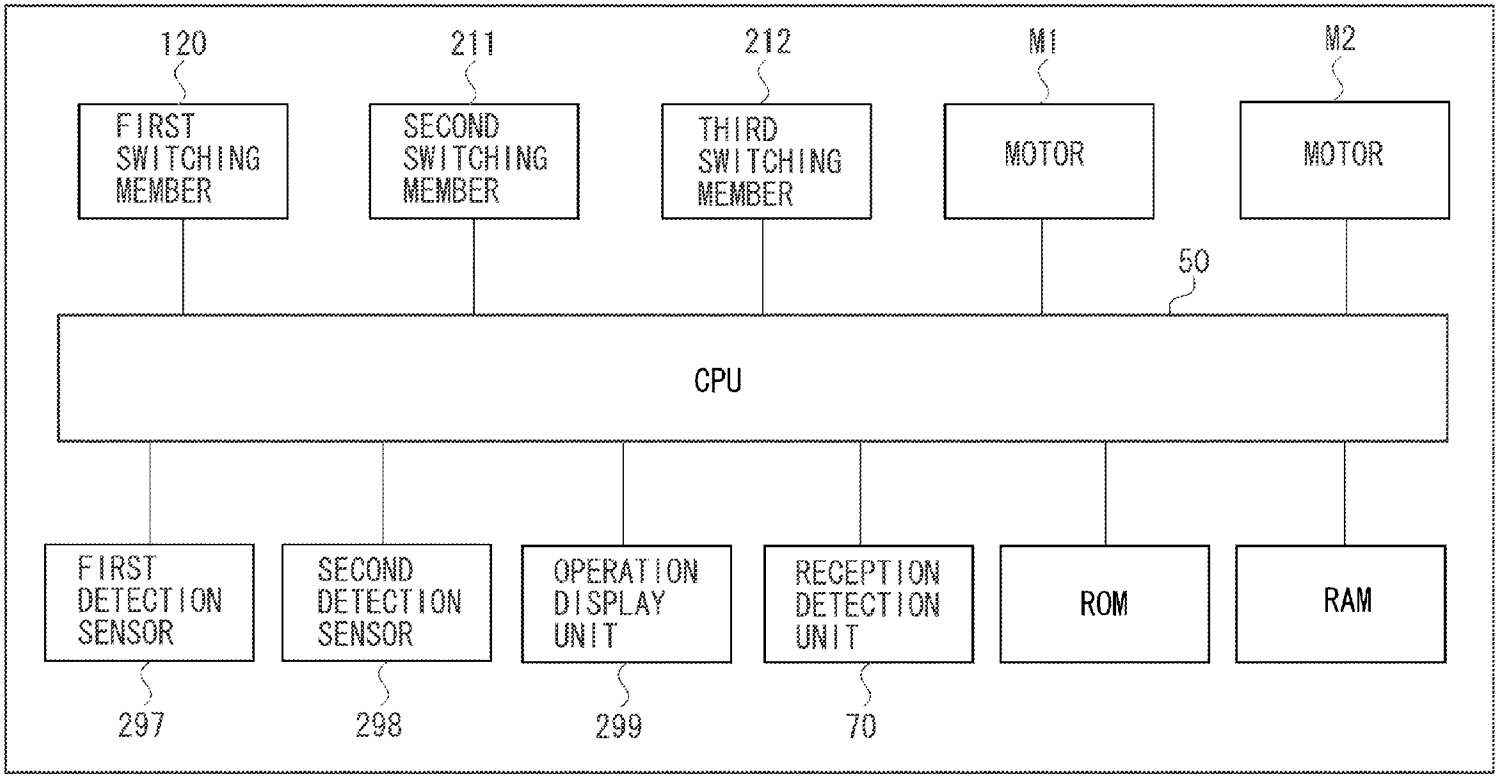
FIG. 11 is a block diagram according to the first exemplary embodiment.

FIG. 11 is a block diagram according to the first exemplary embodiment. As illustrated in FIG. 11, the CPU 50 is connected to a read-only memory (ROM) and a random access memory (RAM). The CPU 50 uses the RAM as a work memory to execute a program stored in the ROM.

Next, an image forming operation of the apparatus body 100 is described. When the apparatus body 100 receives image information from an external apparatus, such as a personal computer (PC), or a network, such as a local area network (LAN), the exposure device 113 emits laser light L based on the image information. The laser light L exposes the surface of the photosensitive drum 111, which is uniformly charged at a predetermined polarity and potential by the charging roller 112.

This removes electric charge from the exposed portion of the surface of the photosensitive drum 111, so that an electrostatic latent image is formed on the surface of the photosensitive drum 111. Then, toner is attached to the photosensitive drum 111 by the developing device 114 to make the electrostatic latent image visible as a toner image. The toner image on the photosensitive drum 111 is transferred onto the sheet S at a transfer nip portion formed between the photosensitive drum 111, which is rotating clockwise, and the transfer roller 115.

On the other hand, the sheet S to be supplied to the image forming unit 101 is separated and fed on a sheet-by-sheet basis from the feeding cassette 105 by the feeding roller 107, and is then conveyed to the registration roller 110 along the conveyance guide 109. At this time, since the registration roller 110 is in a stopped state, the sheet S is temporarily stopped by the registration roller 110. Then, the sheet S, which has been temporarily stopped, is conveyed to the transfer nip portion by the registration roller 110, which starts to rotate with timing synchronized with a toner image formed by the image forming unit 101.

The toner image formed on the photosensitive drum 111 is transferred onto the sheet S by the transfer roller 115. Then, the sheet S having the toner image transferred thereon is conveyed to the fixing unit 103, and is nipped and conveyed by the fixing nip portion formed between the fixing roller 116 and the pressure roller 117. At the fixing nip portion, the sheet S is heated and pressed, so that the toner image is fixed onto the surface of the sheet S.

In a case where the sheet S is to be discharged and stacked onto the discharging stacking member 124, the CPU 50 sets the first switching member 120 to a position (position indicated with the broken line) to convey the sheet S toward the discharging roller 123. Accordingly, the sheet S having an image formed thereon is conveyed along the discharging guide 122 by the conveyance roller 121 and is then discharged onto the discharging stacking member 124 by the discharging roller 123.

On the other hand, in a case where the sheet S is to be conveyed to the sheet storing apparatus 200, the CPU previously sets the first switching member 120 to a position indicated with the solid line in FIG. 8. Accordingly, the sheet S is conveyed toward the sheet storing apparatus 200 from the apparatus body 100 through a conveyance path 128.

The sheet storing apparatus 200 includes a plurality of sheet storing units 201 to 203 that are lapped over one another. Conveyance roller pairs (conveyance members) 204 to 206 respectively convey sheets S to the sheet storing units 201 to 203.

The sheet storing units 201 to 203 respectively include leading-edge restriction members (not illustrated), each of which restricts the downstream edge of the sheet S in the sheet conveyance direction, and discharge ports 234 to 236, via which the sheets S stored in the sheet storing units 201 to 203 are respectively discharged to the outside.

The conveyance destination of the sheet S is switched by a second switching member 211 and a third switching member 212. Thus, the sheet S is guided by the conveyance guides 207 to 210 and is then conveyed to any one of the sheet storing units 201 to 203.

The second switching member 211 and the third switching member 212 are switched between a position indicated with the solid line and a position indicated with the broken line in FIG. 8 by an actuator (not illustrated) controlled by the CPU 50. For example, in a case where the sheet S is to be conveyed to the sheet storing unit 201, the CPU 50 respectively switches the first to third switching members 120, 211, and 212 to the positions indicated with the solid line in FIG. 8. Accordingly, the sheet S passes through the conveyance guides 207 and 208 in this order from the conveyance guide 128, and is then conveyed to the sheet storing unit 201.

Also, in a case where the sheet S is to be conveyed to the sheet storing unit 202, the CPU 50 switches and holds only the third switching member 212 to the position indicated with the broken line. Accordingly, the sheet S passes through the conveyance guides 128, 207, and 209 in this order, and is then conveyed to the sheet storing unit 202.

Next, an operation for discharging the sheet S is described. The CPU 50 can discharge the sheets S stored in the three sheet storing units 201 to 203 at the timing specified based on an instruction from the user. Also, the CPU 50 can arbitrarily select any one of the sheet storing units 201 to 203 to discharge the sheet S from the selected sheet storing unit.

When discharging the sheet S stored in any one of the sheet storing units 201 to 203, the CPU 50 controls a lifting and lowering unit to lift or lower an engaging member 277 (to be described below) to the position corresponding to one of the sheet storing units 201 to 203 storing the sheet S to be discharged. Then, the CPU 50 controls a drive unit to move the engaging member 277 in a discharging direction to discharge the sheet S. The specific configuration and operation of the sheet storing apparatus 200 is described below.

Figure 1:
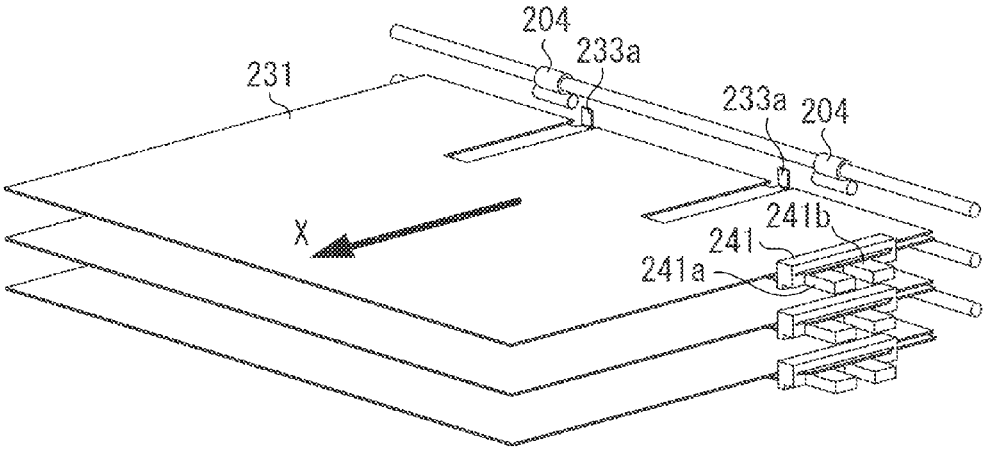
FIG. 1 is a perspective view illustrating a configuration of sheet storing units according to a first exemplary embodiment.
Figure 2:
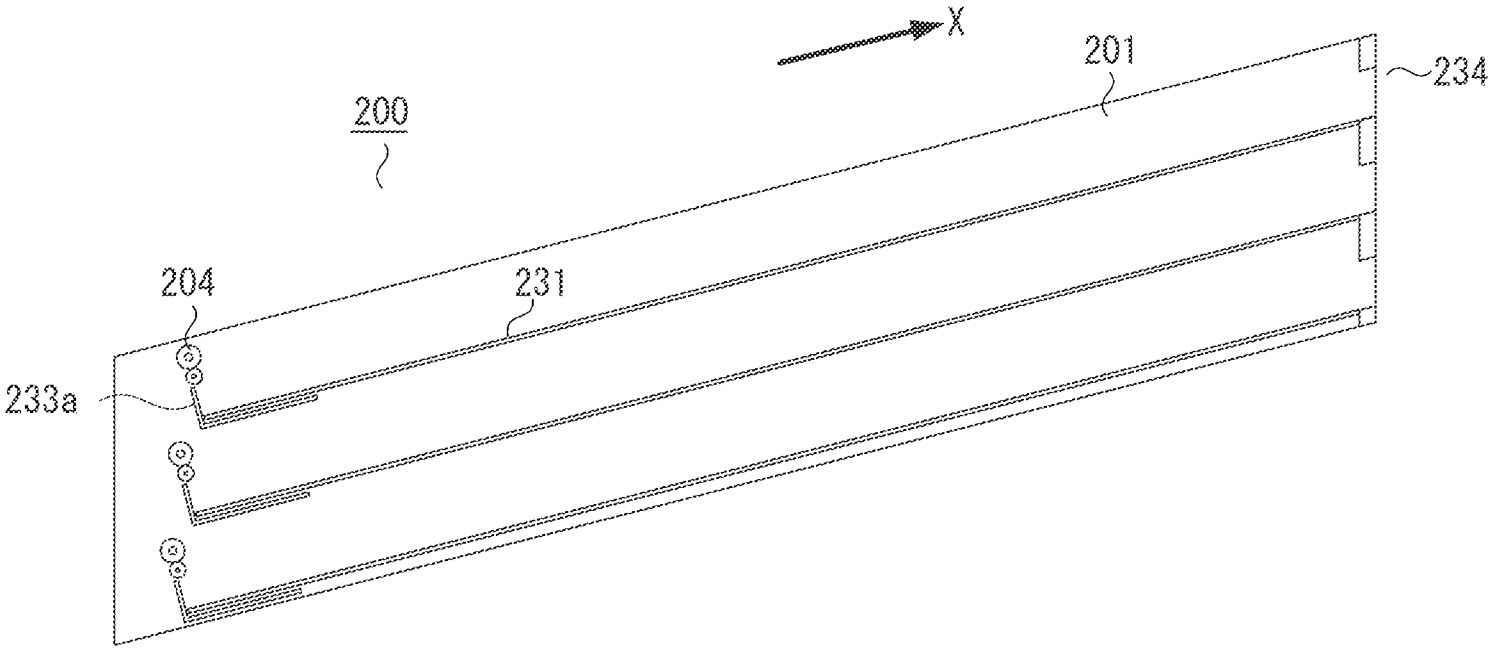
FIG. 2 is a sectional view illustrating a configuration of sheet storing units according to the first exemplary embodiment.

First, the details of the configuration of the sheet storing apparatus 200 are described with reference to FIGS. 1 and 2. FIG. 1 is a perspective view illustrating a configuration of the sheet storing units 201 to 203. FIG. 2 is a sectional view illustrating the configuration of the sheet storing units 201 to 203.

The sheet storing apparatus 200 includes the sheet storing units 201 to 203, which are lapped over one another. The conveyance roller pairs (conveyance members) 204 to 206 respectively convey sheets S to the sheet storing units 201 to 203. In the first exemplary embodiment, since the sheet storing units 202 and 203 have the same configuration as that of the sheet storing unit 201, only the sheet storing unit 201 is described, and the other sheet storing units 202 and 203 are omitted from description.

The sheet storing unit 201 includes a stacking member 231, which is configured to stack thereon the sheet S conveyed by the conveyance roller pair 204, and two contact members 233*a*, which are arranged at two positions along the width direction of the sheet S (the direction perpendicular to the discharging direction of the sheet S) and are configured to contact the upstream edge (trailing edge) of the sheet S in the conveyance direction. The contact members 233*a* each extend in the sheet thickness direction so as to be able to push a plurality of sheets S at a time. In the first exemplary embodiment, the height of each of the contact members 233*a* is set to 5 mm so as to be able to push about 20 sheets at a time. In the first exemplary embodiment, the contact members 233*a* are movable in the conveyance direction of the sheet S (the direction X) to move a plurality of sheets S stacked on the stacking member 231 up to the position where the user can receive a part of the downstream edges of the plurality of sheets S. Thus, the contact members 233*a* are configured to be movable to expose a plurality of sheets S to the outside of the sheet storing apparatus 200 via the discharge port 234.

The sheet storing unit 201 further includes a drive transmission unit 241. The drive transmission unit 241 transmits a driving force from a motor M1 (to be described below), which generates a driving force for moving the contact members 233*a*, to the contact members 233*a*. The drive transmission unit 241 includes a first engaged member 241*a* and a second engaged member 241*b*.

An engagement surface 277*a* of an engaging member 277 (to be described below) engaging with the first engaged member 241*a* or the second engaged member 241*b* enables the contact members 233*a* to be moved in the sheet discharging direction (the direction X) or in the opposite direction.

The drive transmission unit 241 and the engaging member 277 are located on the outside of the stacking member 231 in the sheet width direction, which is orthogonal to the sheet discharging direction (the direction X). The sheet storing units 201 to 203 described above are arranged to be lapped over one another in the sheet thickness direction (the stacking direction).

Figure 3A:
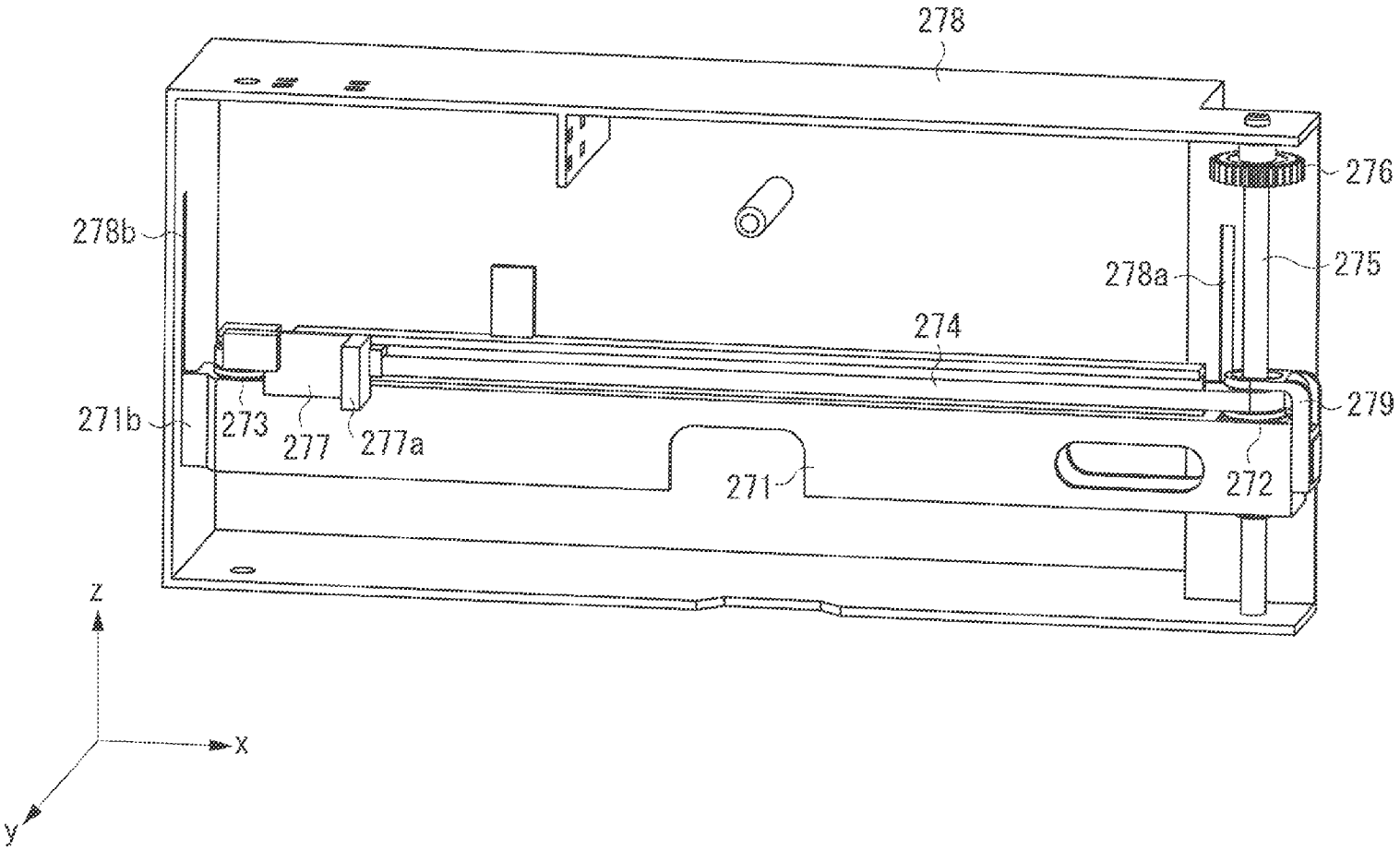
FIGS. 3A, 3B, and 3C illustrate a configuration of a drive unit according to the first exemplary embodiment.
Figure 3B:
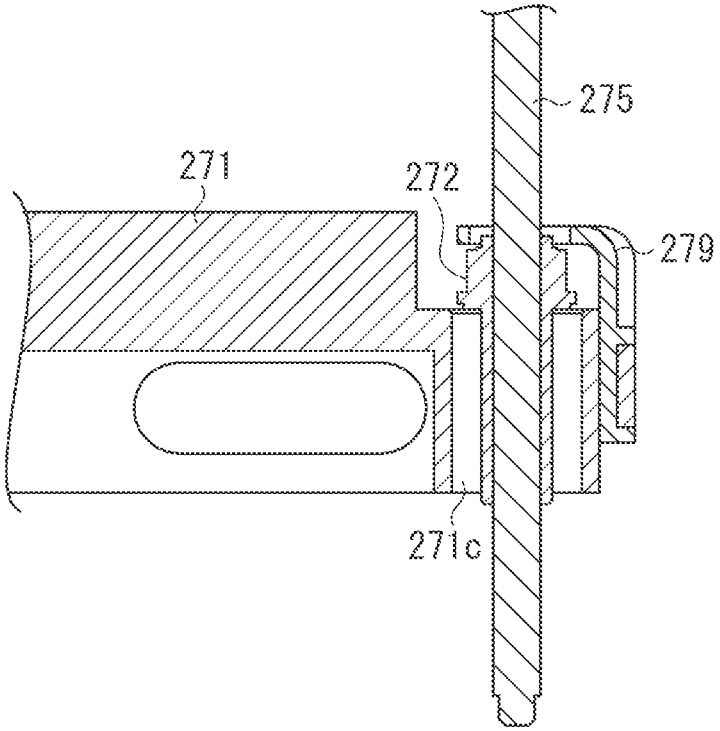
Figure 3C:
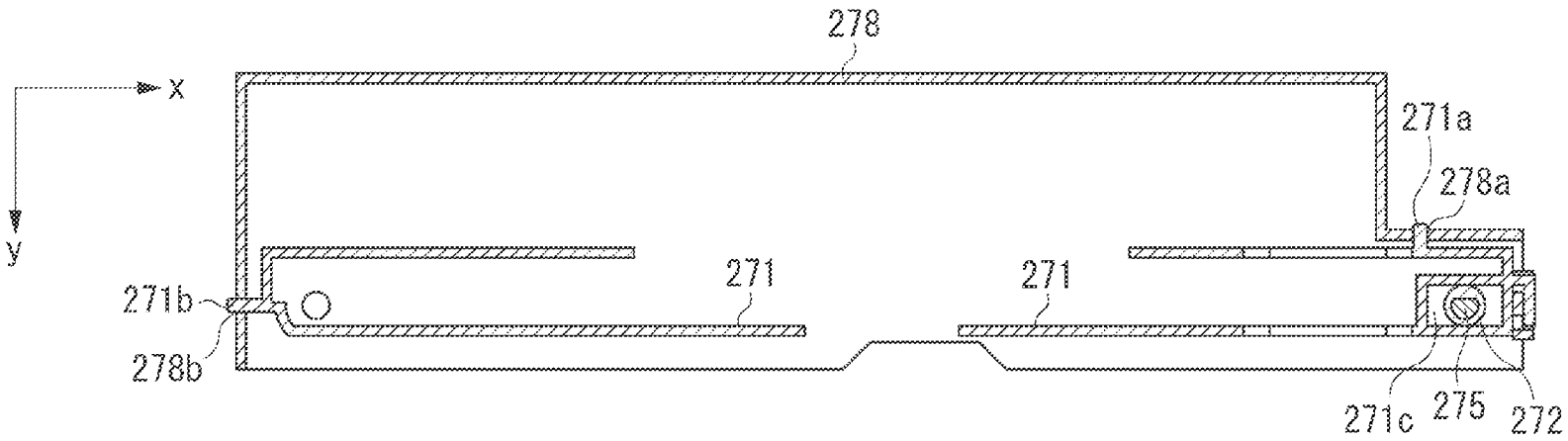

Next, the engaging member 277, which engages with the first engaged member 241*a* and the second engaged member 241*b*, and a drive unit that drives the engaging member 277 are described with reference to FIGS. 3A, 3B, and 3C. FIGS. 3A, 3B, and 3C illustrate only principal constituent components of the drive unit, and does not illustrate constituent components of a lifting and lowering unit (to be described below).

FIG. 3A is a perspective view of the drive unit, FIG. 3B is a sectional view of the drive unit, and FIG. 3C is a sectional view of the drive unit as viewed from the top surface. The drive unit includes a motor M1 (a first drive source) (FIG. 4), a drive frame 271, a driving pulley 272, a driven pulley 273, a drive belt 274, a drive shaft 275, a drive gear 276, the engaging member 277, and a driving pulley restriction member 279.

A support frame 278 supports the drive unit and the lifting and lowering unit (to be described below), and is supported by a structure (not illustrated) forming the sheet storing apparatus 200.

The drive frame 271 is supported by the support frame 278 and the drive shaft 275. The specific supporting method is described with reference to FIGS. 3B and 3C. The drive shaft 275 is supported with a hole (not illustrated) of the support frame 278 to be rotatable and to be restricted from moving in the z direction in FIG. 3A.

The driving pulley 272 is mounted to be movable in the axial direction of the drive shaft 275. Furthermore, the driving pulley 272 is formed in a D-cut shape to be rotatable integrally with the drive shaft 275. The driving pulley 272 is located to pass through a support hole 271*c* of the drive frame 271 as illustrated in FIG. 3B.

The support hole 271*c* is fitted on the driving pulley 272 in the width direction of the sheet S (the y direction) as illustrated in FIG. 3C. The driving pulley 272 is supported by the driving pulley restriction member 279 to be rotatable relative to the drive frame 271 and to be movable integrally with the drive frame 271 in the z direction in FIG. 3A.

As described above, the position of the drive frame 271 in the width direction of the sheet S (the y direction) is restricted by the driving pulley 272 and the drive shaft 275. Furthermore, as illustrated in FIG. 3C, an x-direction restriction rib 271*a* and a y-direction restriction rib 271*b* are respectively fitted into an x-direction restriction hole 278*a* and a y-direction restriction hole 278*b* of the support frame 278. Accordingly, the position of the drive frame 271 in the discharging direction of the sheet S (the x direction) and the width direction of the sheet S (the y direction) is restricted, and the drive frame 271 is supported to be movable only in the thickness direction of the sheet S (the z direction).

The driven pulley 273 is supported to be rotatable relative to the drive frame 271 and to be restricted from moving in the vertical direction relative to the drive frame 271. The drive belt 274 is supported and stretched around the driven pulley 273 and the driving pulley 272. The tension of the drive belt 274 can be appropriately adjusted by optimizing the center distance between the driving pulley 272 and the driven pulley 273.

The engaging member 277 is fixed to the drive belt 274 while pinching the drive belt 274. The engaging member 277 is movable in the x direction and the z direction integrally with the drive belt 274.

Figure 4:
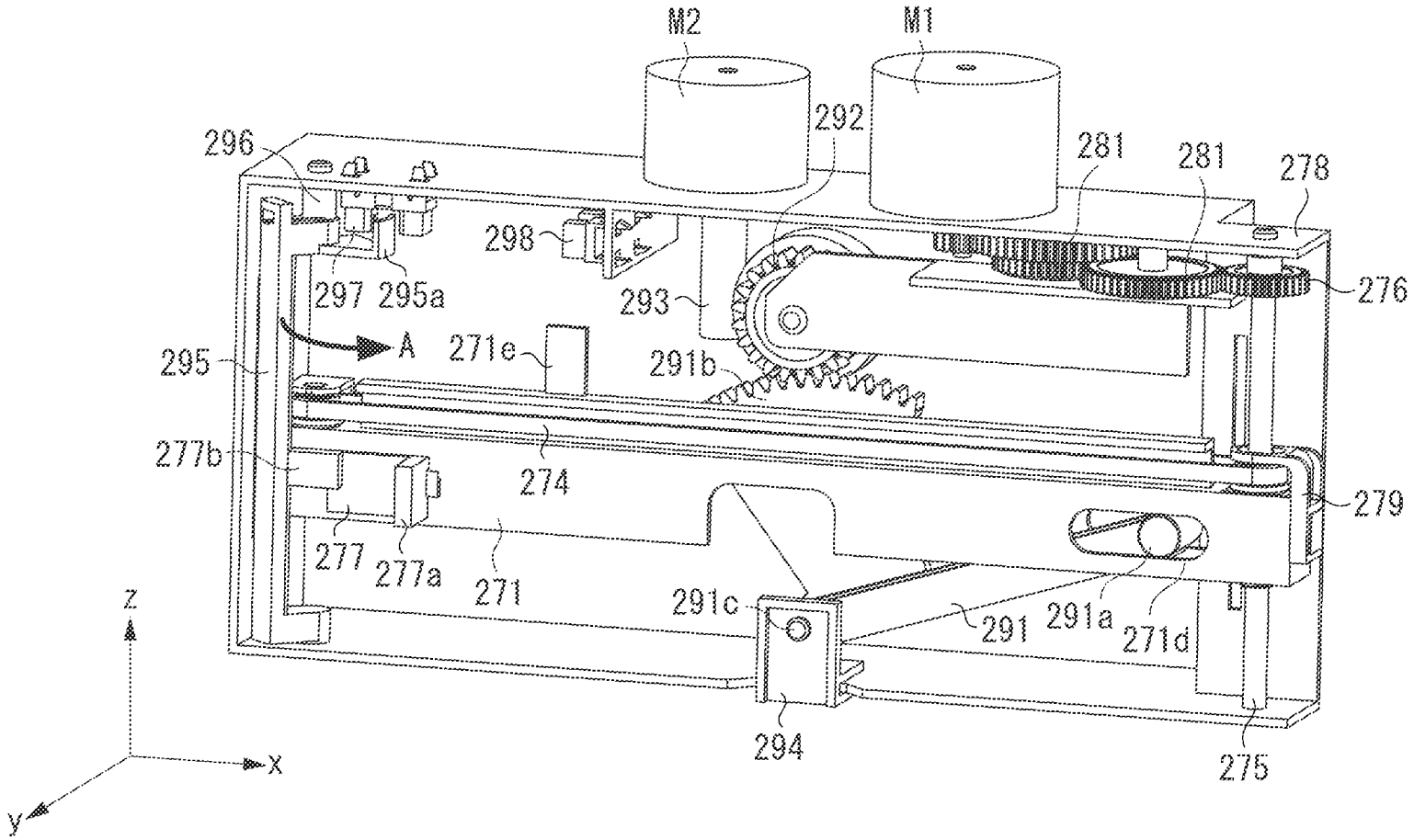
FIG. 4 is a perspective view illustrating a configuration of a lifting and lowering unit according to the first exemplary embodiment.

As illustrated in FIG. 4, a drive force for moving the engaging member 277 is transmitted from the motor M1, which is a stepping motor mounted on the support frame 278, to the drive gear 276 via a gear train 281.

The drive gear 276 is fixed with a D-cut shape or a parallel pin to be rotatable integrally with the drive shaft 275 to transmit the drive force to the drive shaft 275. The drive force transmitted to the drive shaft 275 is transmitted to the driving pulley 272, which rotates integrally with the drive shaft 275, to drive the drive belt 274 in the x direction. Accordingly, the engaging member 277 also moves in the x direction integrally with the drive belt 274. When the CPU 50 causes the motor M1 to rotate forward or backward, the engaging member 277 moves integrally with the drive belt 274 in the x direction or the opposite direction.

Next, the lifting and lowering unit, which lifts and lowers the engaging member 277, is described with reference to FIG. 4. FIG. 4 is a perspective view illustrating the drive unit and the lifting and lowering unit together with the support frame 278. The lifting and lowering unit includes a stepping motor M2 (a second drive source), a lifting and lowering lever 291, a lifting and lowering gear 292, a lifting and lowering worm gear 293, and a lifting and lowering lever support member 294.

The lifting and lowering lever 291 includes a lifting and lowering shaft 291*a*, a lifting and lowering sector gear 291*b*, and a lifting and lowering rotational shaft 291*c*. The lifting and lowering shaft 291*a* is engaged with a lifting and lowering hole 271*d* formed in the drive frame 271. The lifting and lowering rotational shaft 291*c* is supported to be rotatable by the lifting and lowering lever support member 294 and the support frame 278, to which the lifting and lowering lever support member 294 is coupled.

The drive force from the motor M2, which is transmitted to the lifting and lowering sector gear 291*b* via the lifting and lowering worm gear 293 and the lifting and lowering gear 292, causes the lifting and lowering lever 291 to rotate around the lifting and lowering rotational shaft 291*c*. When the CPU 50 causes the motor M2 to rotate forward or backward, the lifting and lowering lever 291 rotates to move the lifting and lowering shaft 291*a* up or down.

When the lifting and lowering shaft 291*a* moves up or down, the drive frame 271 moves up or down integrally with the lifting and lowering shaft 291*a*. At this time, since the lifting and lowering shaft 291*a* is driven near the x-direction restriction rib 271*a* of the drive frame 271 and the restriction hole 278*a* of the support frame 278, an excessive moment is less easily applied to the restriction rib 271*a* and the restriction hole 278*a*, so that the drive frame 271 can move steadily. The configuration for lifting and lowering the engaging member 277 is not limited to the above-described configuration. For example, a rack and pinion mechanism may be used to lift and lower the engaging member 277.

The sheet storing apparatus 200 further includes a first detection unit that detects the position of the engaging member 277 in the x direction and a second detection unit that detects the position of the engaging member 277 in the z direction.

The first detection unit includes a first sensor flag 295, which is supported by the support frame 278 to be rotatable, a first sensor spring 296, which urges the first sensor flag 295 in the direction A in FIG. 4, and a first detection sensor 297. The first detection unit is able to detect that the engaging member 277 is located in an initial position in the x direction. In other words, the first detection unit is able to detect whether the engaging member 277 has been moved by the drive unit.

The second detection unit, which detects the position of the engaging member 277 in the z direction, includes a second detection flag 271*e*, which is formed on the drive frame 271, and a second detection sensor 298, which is mounted on the support frame 278. The second detection unit is able to detect that the engaging member 277 is located in an initial position in the z direction.

The first detection sensor 297 and the second detection sensor 298 each are composed of a photo-interrupter that detects transmission and blocking of light.

When the engaging member 277 is in an initial position, a flag contact portion 277*b* formed on the engaging member 277 pushes the first sensor flag 295. Then, a first sensor light blocking portion 295*a* of the first sensor flag 295 blocks the first detection sensor 297 from light, so that the first detection unit detects that the engaging member 277 is in the initial position.

To discharge sheets S stored in any one of the sheet storing units 201 to 203, the CPU 50 controls the motor M1 to move the engaging member 277 from the initial position to the discharging position (in the x direction). When the engaging member 277 moves in the x direction, the first sensor flag 295 moves in the direction A in FIG. 4 due to the urging force of the first sensor spring 296. Then, the first detection sensor 297 comes into a light-transmissive state, so that the first detection unit detects that the engaging member 277 is not in the initial position.

When the engaging member 277 is in the initial position in the z direction, the second detection flag 271*e* blocks the second detection sensor 298 from light, so that the second detection unit detects that the engaging member 277 is in the initial position. In the first exemplary embodiment, the initial position of the engaging member 277 in the z direction is set to a position corresponding to the sheet storing unit 201.

To discharge sheets S stored in any one of the sheet storing units 202 and 203, the CPU 50 controls the motor M2 to lower the engaging member 277 from the initial position in the minus z direction. When the second detection flag 271*e*, which is lifted and lowered integrally with the engaging member 277, moves in the minus z direction, the second detection sensor 298 comes into a light-transmissive state, so that the second detection unit detects that the engaging member 277 is not in the initial position.

As described above, the sheet storing apparatus 200 is able to detect, via the first detection unit and the second detection unit, the initial position of the engaging member 277 in the x direction and the z direction. In other words, the sheet storing apparatus 200 is able to recognize the accurate positions (states) of the drive unit, which moves the engaging member 277 in the x direction, and the lifting and lowering unit, which moves the engaging member 277 in the z direction.

Furthermore, according to the first exemplary embodiment, since the motor M1 of the drive unit and the motor M2 of the lifting and lowering unit each are a stepping motor, the sheet storing apparatus 200 can control the movement and stop of the engaging member 277 with high precision.

Figure 5A:
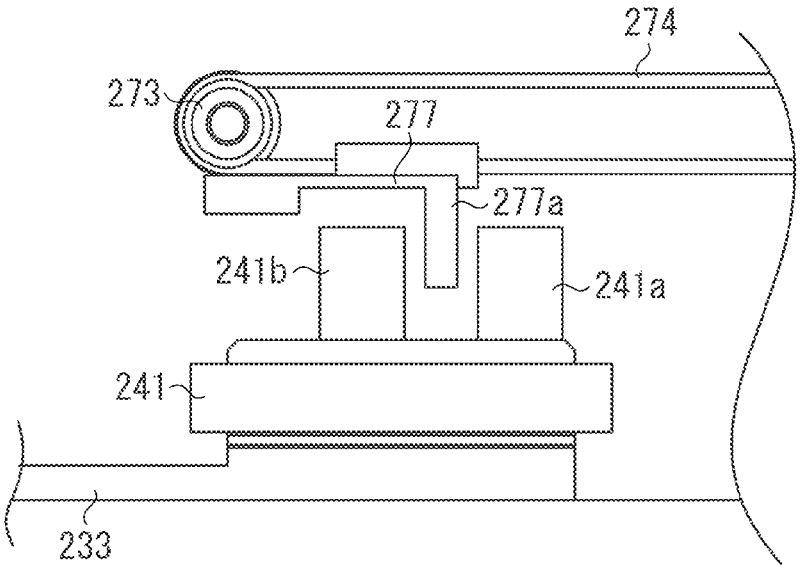
FIGS. 5A and 5B illustrate a positional relationship between an engaging member and a drive transmission member.
Figure 5B:
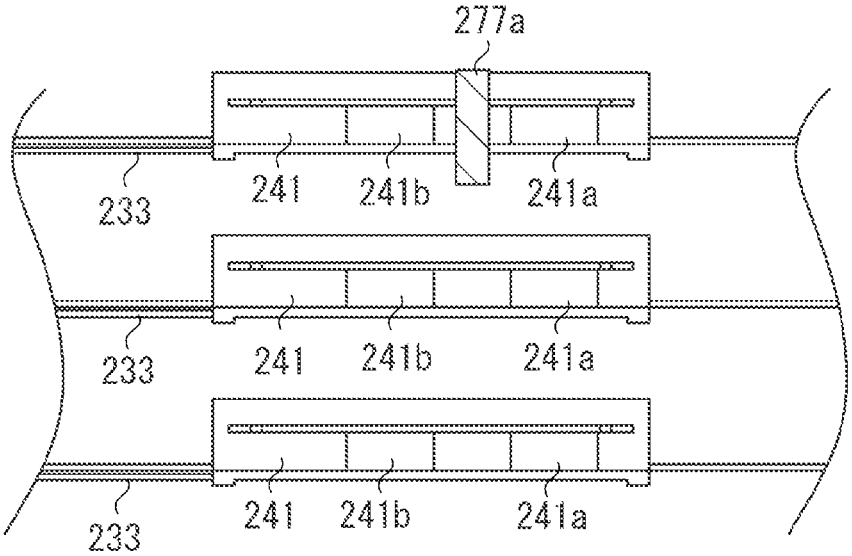

Next, a positional relationship between the engaging member 277, which is lifted and lowered by the lifting and lowering unit, and the drive transmission unit 241 is described with reference to FIGS. 5A and 5B. FIG. 5A illustrates the positional relationship between the engaging member 277 and the drive transmission unit 241 as viewed from above the sheet storing apparatus 200. FIG. 5B illustrates the drive transmission unit 241 as viewed from the side of the engaging member 277.

When the engaging member 277 is in the initial position in the x direction, the engagement surface 277*a* of the engaging member 277 is located between the first engaged member 241*a* and the second engaged member 241*b*, as illustrated in FIG. 5A. Thus, in this state, the first engaged member 241*a* does not engage with any of the first engaged member 241*a* and the second engaged member 241*b*.

Furthermore, as illustrated in FIG. 5B, the sheet storing units 201 to 203 are lapped over one another such that, when the lifting and lowering unit lifts and lowers the engaging member 277, the engagement surface 277*a* of the engaging member 277 always passes through a space between the first engaged member 241*a* and the second engaged member 241*b* of each of the sheet storing units 201 to 203.

Figure 6:
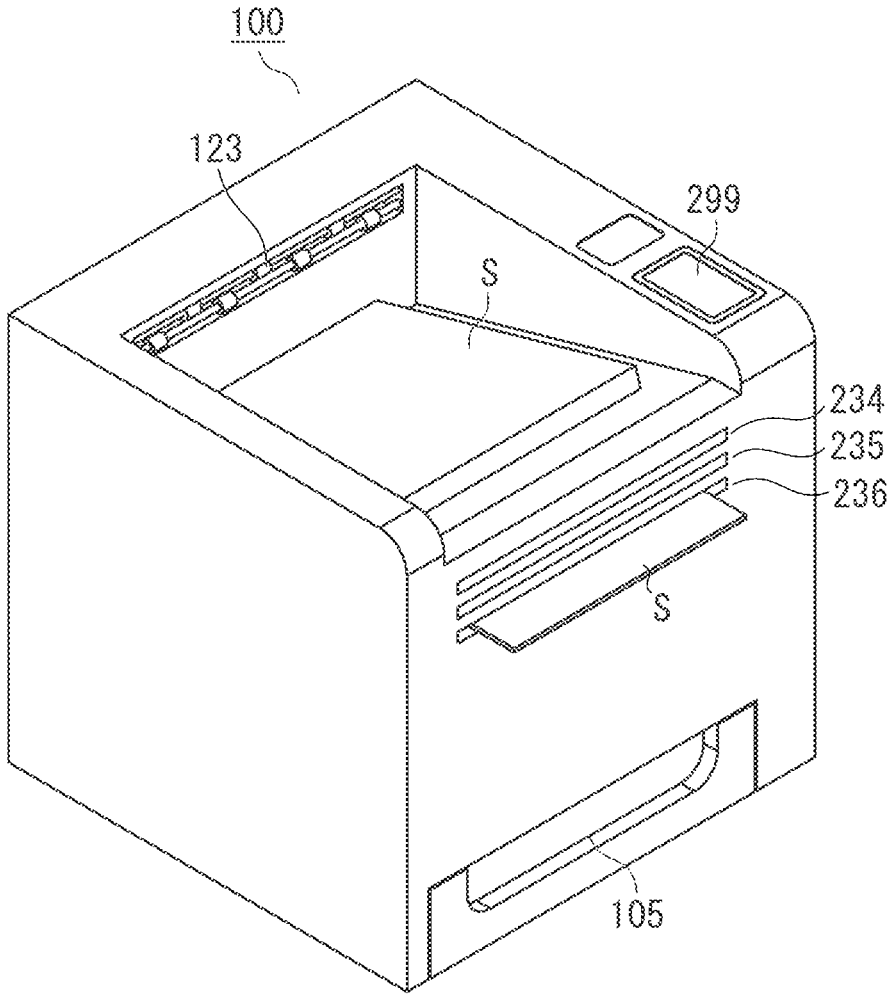
FIG. 6 is a perspective view illustrating an external appearance of an image forming apparatus according to the first exemplary embodiment.
Figure 7A:
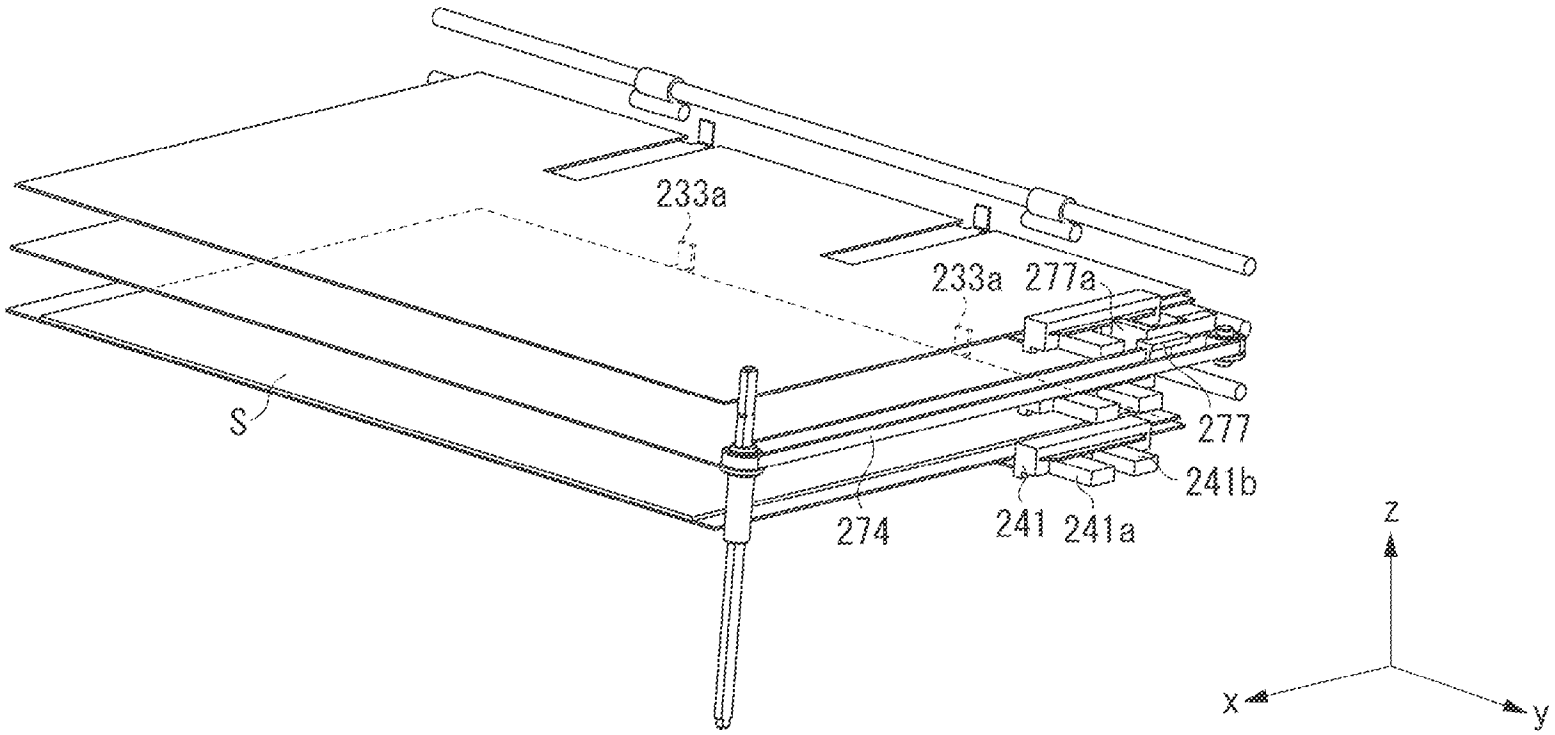
FIGS. 7A, 7B, and 7C are perspective views illustrating a sheet discharging operation.
Figure 7B:
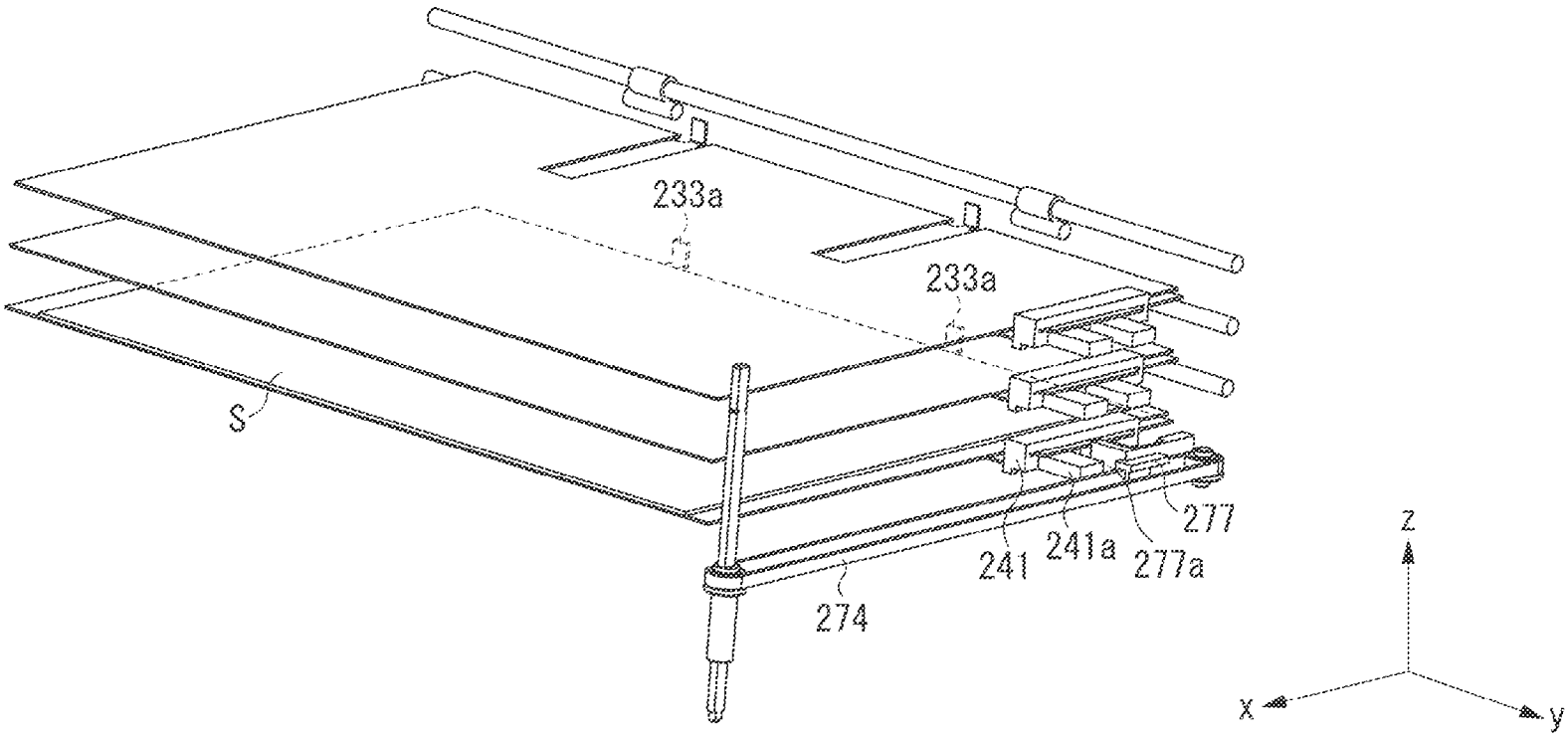
Figure 7C:
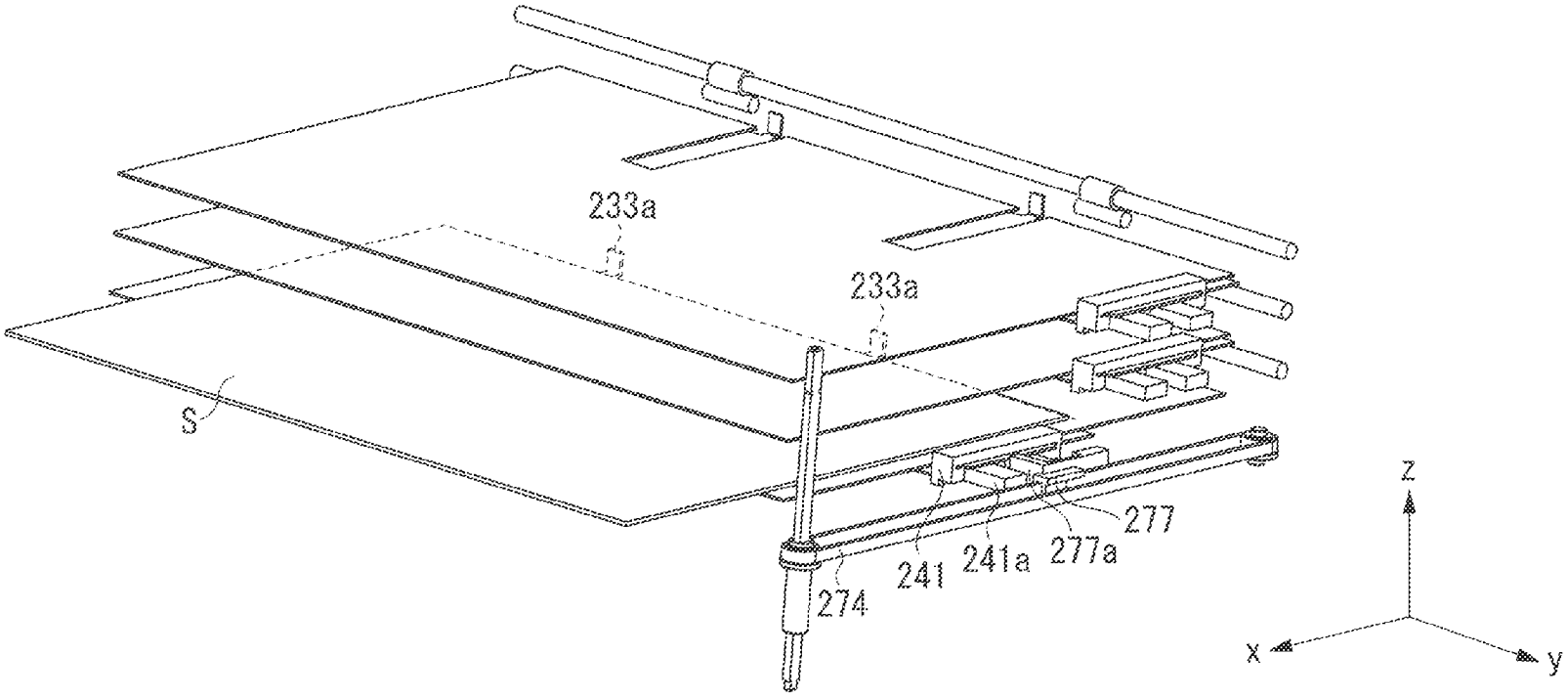

Next, the operation for discharging the sheet S stored in any one of the sheet storing units 201 to 203 is described with reference to FIG. 6 and FIGS. 7A, 7B, and 7C. FIG. 6 is a perspective view illustrating an external appearance of the image forming apparatus 100. FIGS. 7A, 7B, and 7C are perspective views illustrating a sheet discharging operation.

For ease of description, FIGS. 7A, 7B, and 7C illustrate only principal components. Furthermore, the contact members 233*a* of the sheet storing unit 203 and the sheet S are indicated with the broken line for easy understanding of the operation, while, in reality, those are made invisible by being hidden by the upper sheet storing units 201 and 202.

For example, in a case where the user intends to receive a plurality of sheets S stored in the sheet storing unit 203, the user issues a discharging instruction via an operation display unit 299 (illustrated in FIG. 6) mounted on the image forming apparatus 100.

When the image forming apparatus 100 has received the discharging instruction, the CPU 50 controls the lifting and lowering unit to move the engaging member 277 in the thickness direction of the sheet S (the minus z direction) from the initial position illustrated in FIG. 7A. Then, as illustrated in FIG. 7B, the engagement surface 277*a* of the engaging member 277 moves into a space between the engaged members 241*a* and 241*b* of the sheet storing unit 203.

When the engaging member 277 has completely moved, the CPU 50 controls the drive unit to move the engaging member 277 in the discharging direction of the sheet S (the x direction). When the engaging member 277 moves in the x direction and the engagement surface 277*a* engages with the first engaged member 241*a*, the engaging member 277 and the drive transmission unit 241 move integrally in the x direction. Thus, when the contact members 233*a* move to move the sheet S, the engaging member 277 and the first engaged member 241*a* engage with each other.

As the drive transmission unit 241 moves in the x direction, the contact members 233*a* also move integrally in the x direction, so that the sheets S are discharged from the discharge port 236, as illustrated in FIG. 7C. The discharged sheets S are exposed to the outside of the image forming apparatus 100 by a length easily receivable by the user. Thus, the user can receive the sheets S.

When a reception detection unit 70 (illustrated in FIG. 11), which is mounted in the vicinity of the discharge port 236, detects that the sheets S have been received by the user, the CPU 50 starts an operation to return the engaging member 277 and the contact members 233*a* from the discharging position to the initial position. Thus, when the contact members 233*a* return to the initial position after moving the sheets S, the engaging member 277 and the second engaged member 241*b* engage with each other.

To return the engaging member 277 and the contact members 233*a* to the initial position, the CPU 50 causes the motor M1 to rotate in the direction opposite to that used for the discharging operation. Accordingly, since the drive belt 274 also rotates in the direction opposite to that used for the discharging operation, the engaging member 277, which moves integrally with the drive belt 274, can return to the initial position.

At this time, since the engagement surface 277*a* engages with the second engaged member 241*b*, which is on the side opposite to that used for the discharging operation, the contact members 233*a* can return to the initial position. When the engaging member 277 returns to the initial position, the flag contact portion 277*b* pushes the first sensor flag 295, so that the CPU 50 can recognize that the engaging member 277 has returned to the initial position. At the time the engaging member 277 has returned to the initial position, the lifting and lowering unit lifts the engaging member 277 up to the initial position in the z direction. Thus, the sheet storing apparatus 200 makes ready to perform a next discharging operation for the sheets S.

As described above, in the first exemplary embodiment, each of the sheet storing units 201 to 203 includes the contact members 233*a*, which are movable to discharge the sheet S, and the drive transmission unit 241, which is driven to move the contact members 233*a*. Furthermore, in the first exemplary embodiment, the engaging member 277, which is small and light, is configured to be lifted and lowered to the positions respectively corresponding to the sheet storing units 201 to 203.

Thus, according to the first exemplary embodiment, in a sheet storing apparatus equipped with a plurality of sheet storing units 201 to 203, sheets can be discharged without lifting and lowering the sheet storing units.

Furthermore, according to the first exemplary embodiment, the configuration for discharging sheets S stored in the sheet storing units 201 to 203 can be simplified, and the reduction in size and power consumption of a motor as a drive source can be attained.

Next, a second exemplary embodiment of the present invention is described. In the second exemplary embodiment, the description of configurations and operations similar to those of the first exemplary embodiment is not repeated as appropriate. The second exemplary embodiment differs from the first exemplary embodiment in the configuration of a drive transmission unit, which transmits a drive force to the contact members 233*a*.

Figure 9A:
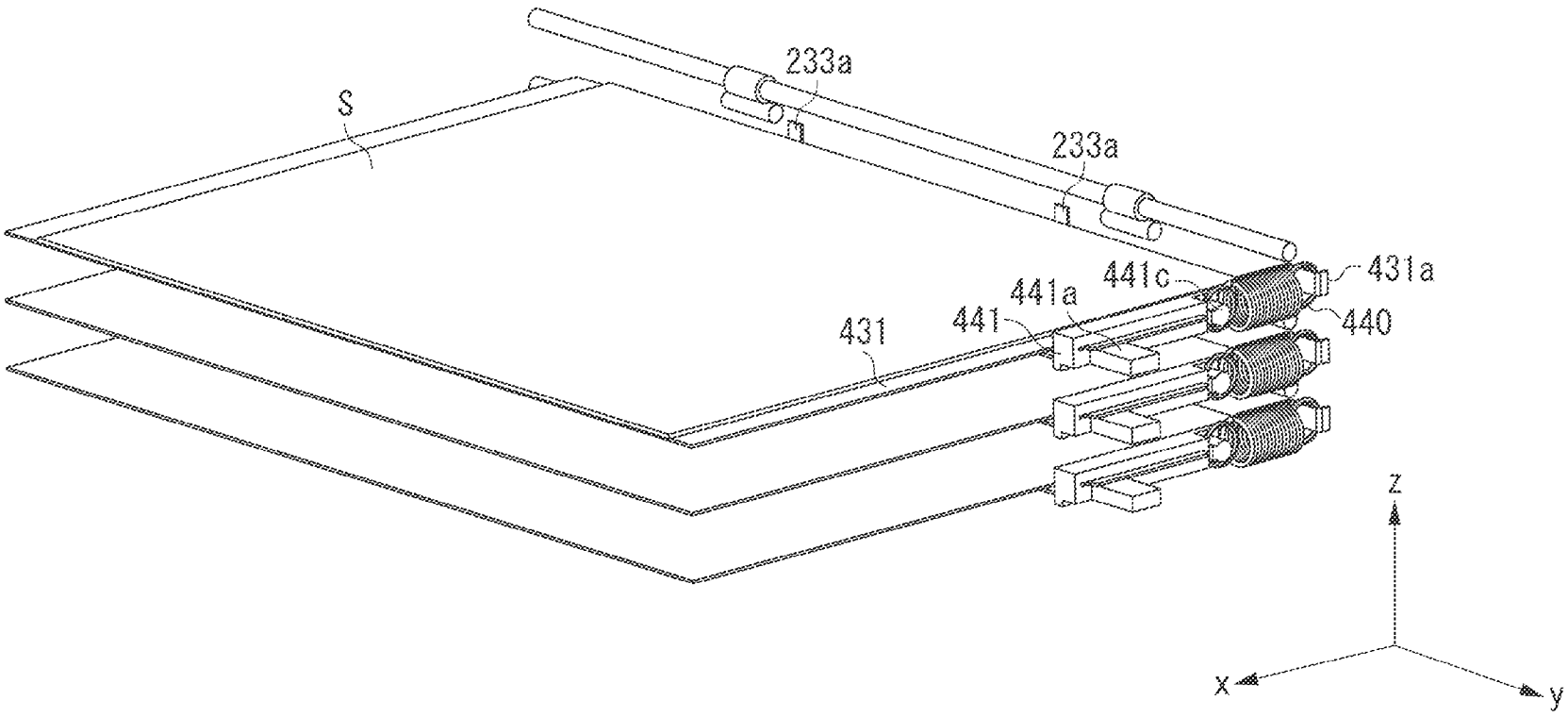
FIGS. 9A and 9B are perspective views illustrating a sheet discharging operation according to a second exemplary embodiment.
Figure 9B:
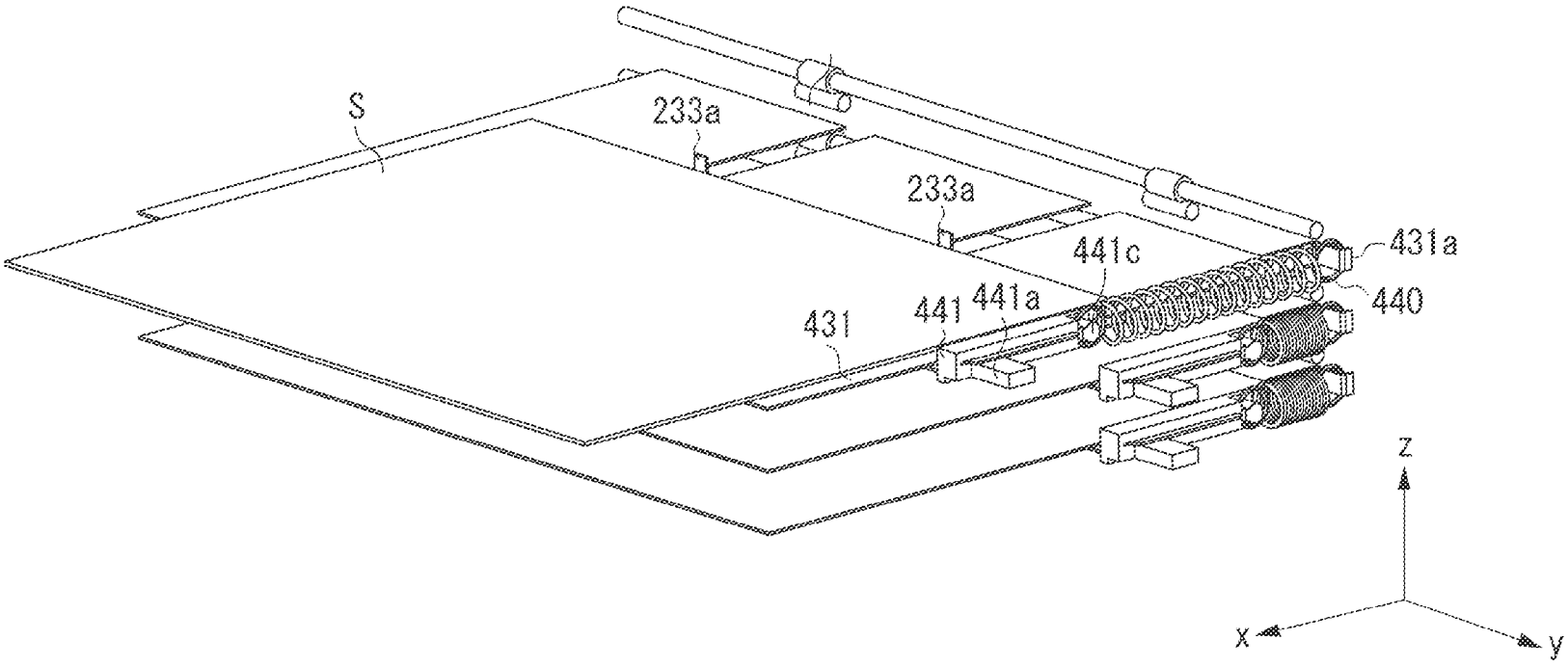

FIGS. 9A and 9B are perspective views illustrating constituent components characteristic of the second exemplary embodiment. In the second exemplary embodiment, a drive transmission unit 441 includes a single engaged member 441*a*. The engaged member 441*a* is engaged with the engaging member 277 and is then moved from the initial position to the discharging position, as in the first exemplary embodiment.

In the second exemplary embodiment, the drive transmission unit 441 further includes a return spring 440 (an urging member), which operates to return the engaged member 441*a* from the discharging position to the initial position. The return spring 440 is arranged to be hooked to a spring catch portion 441*c* formed on the drive transmission unit 441 and to a spring catch portion 431*a* formed on a stacking member 431.

Next, an operation of the second exemplary embodiment is described.

For example, in a case where the user intends to receive sheets S from the sheet storing unit 201, the user issues a discharging instruction via the operation display unit 299 (illustrated in FIG. 6) of the image forming apparatus 100. When the CPU 50 of the image forming apparatus 100 has received the discharging instruction, the CPU 50 controls the lifting and lowering unit to lift or lower the engaging member 277 to a position corresponding to one of the sheet storing units 201 to 203 targeted for the discharging instruction. In this example, since the sheet storing unit 201 is targeted for the discharging instruction, the lifting and lowering unit is not required to lift or lower the engaging member 277.

Then, the CPU 50 controls the drive unit to drive the engaging member 277, thus discharging the sheets S, as illustrated in FIG. 9B. The configuration and operation of the drive unit are similar to those of the first exemplary embodiment, and the description thereof is, therefore, not repeated here. At this time, the return spring 440 is pulled by the engaged member 441*a* moving in the x direction, so that the load of the return spring 440 is charged. Since the engaged member 441*a* is pulled by the return spring 440, the engaged member 441*a* continues being pushed against the engagement surface 277*a*.

To return the contact members 233*a* from the discharging position to the initial position, the CPU 50 drives the drive unit in a manner similar to that in the first exemplary embodiment. When the engaging member 277 starts moving from the discharging position to the initial position, the engaged member 441*a*, which is pushed against the engagement surface 277*a*, is also moved by the urging force of the return spring 440.

As described above, in the second exemplary embodiment, the drive transmission unit 441 includes the return spring 440 and the single engaged member 441*a*. Accordingly, the second exemplary embodiment has the effect of reducing sound noise generated when the engaged member 441*a* returns from the discharging position to the initial position, in addition to advantageous effects similar to those of the first exemplary embodiment. This is because, in the second exemplary embodiment, there is no sound noise that would be generated when the engaging member 277 contacts the second engaged member 241*b* as in the first exemplary embodiment.

Next, a third exemplary embodiment of the present invention is described. In the third exemplary embodiment, the description of configurations and operations similar to those of the first exemplary embodiment is not repeated as appropriate. The third exemplary embodiment differs from the first exemplary embodiment in the configuration of a drive unit, which drives an engaging member 577 in the x direction.

Figure 10A:
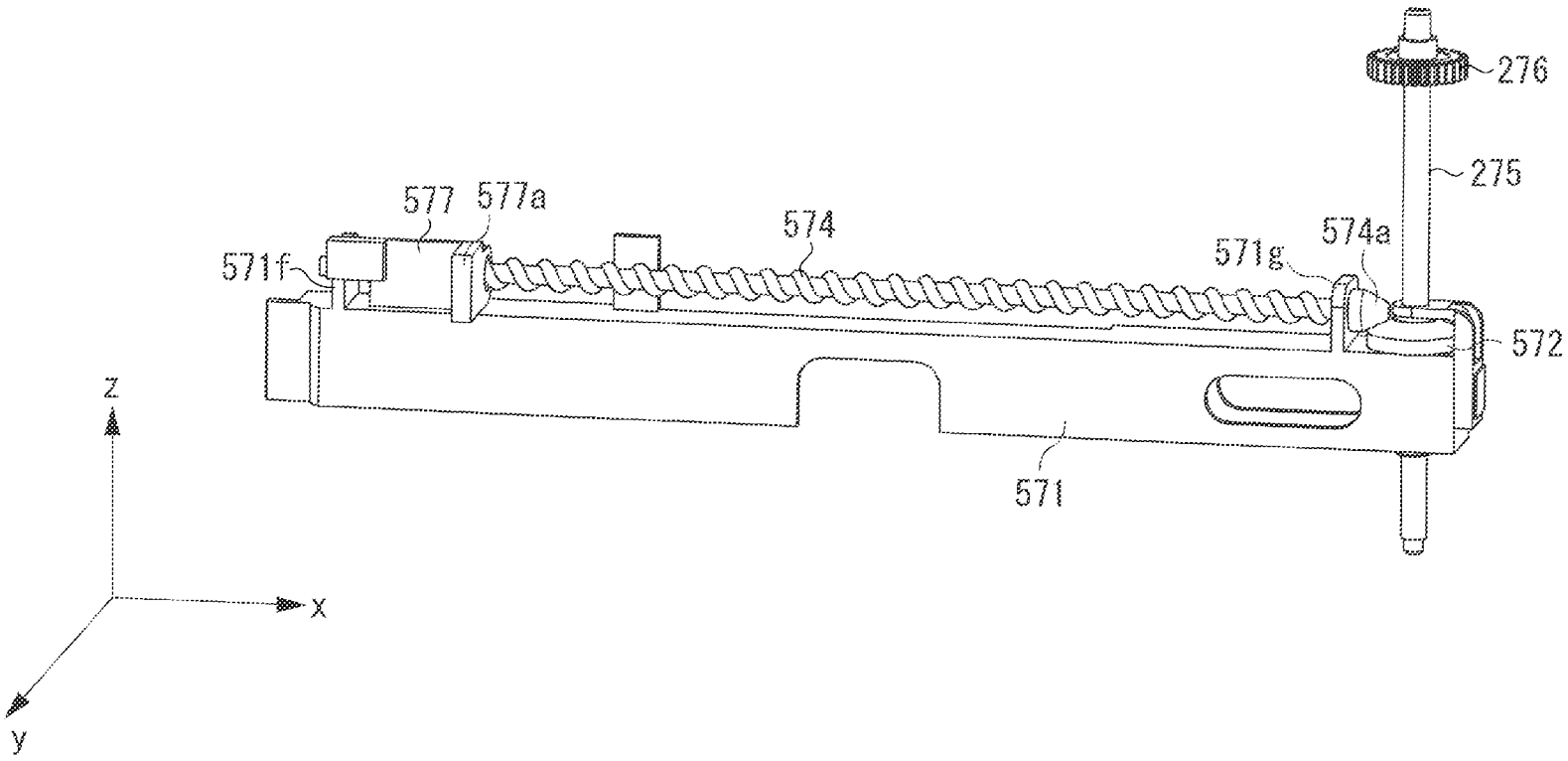
FIGS. 10A and 10B are perspective views illustrating a configuration of a drive unit according to a third exemplary embodiment.
Figure 10B:
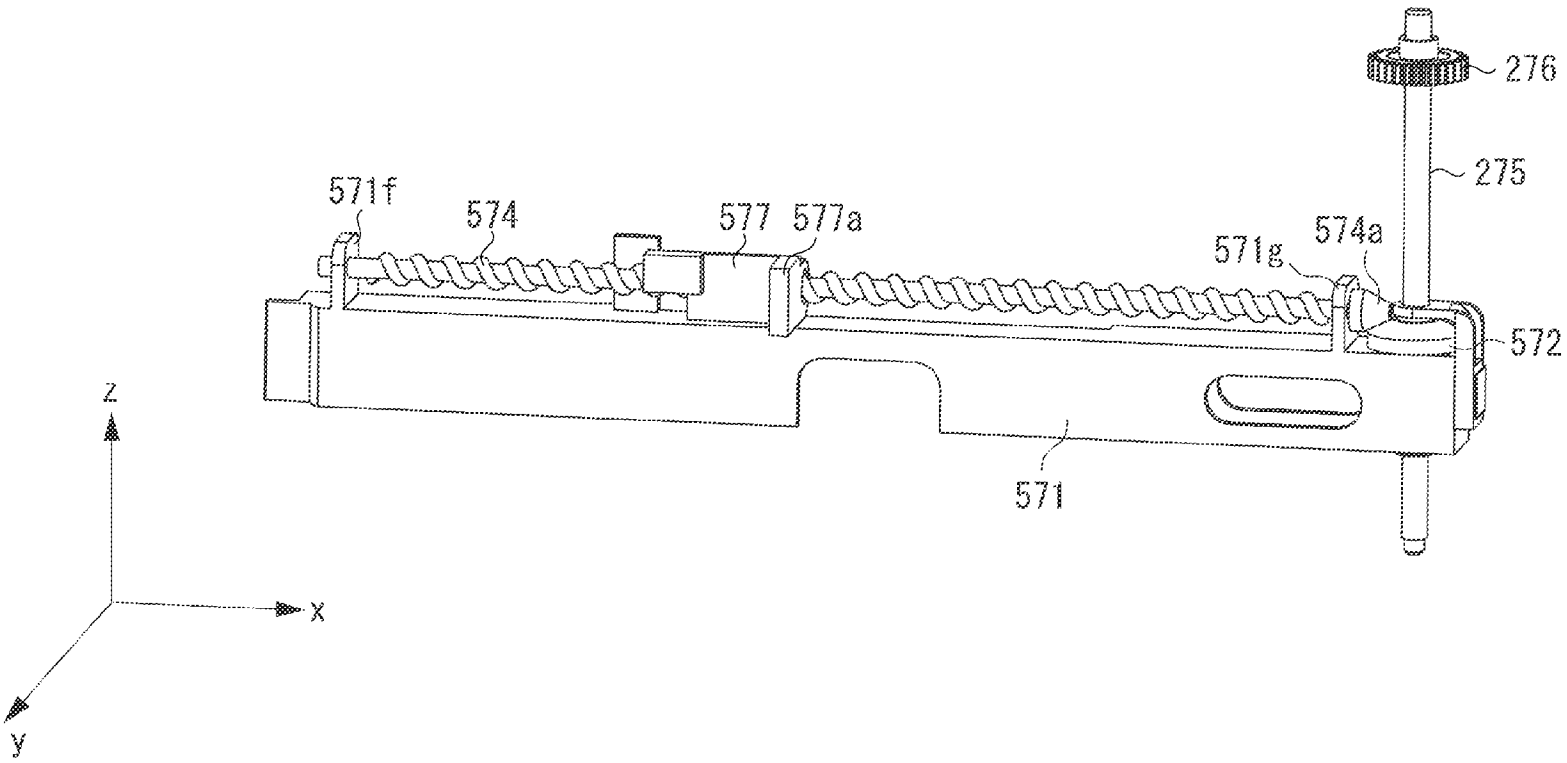

FIGS. 10A and 10B are perspective views illustrating constituent components characteristic of the third exemplary embodiment. In the third exemplary embodiment, the drive unit includes a screw shaft 574, which has a spiral groove, and a bevel gear 572 to drive the engaging member 577 in the x direction.

In the third exemplary embodiment, like the first exemplary embodiment, a drive force from the motor M1 is transmitted to the drive gear 276 and the drive shaft 275 via a gear train. The drive force transmitted to the drive shaft 275 is transmitted to the bevel gear 572. The bevel gear 572 is movable in the z direction and is mounted to be rotatable integrally with the drive shaft 275.

The screw shaft 574 is supported by shaft holding portions 571*f* and 571*g* formed on a drive frame 571 to be rotatable. A screw shaft bevel gear 574*a* formed integrally with the screw shaft 574 meshes with the bevel gear 572. Accordingly, the drive force transmitted to the bevel gear 572 is transmitted to the screw shaft bevel gear 574*a*.

The engaging member 577 engages with the spiral groove of the screw shaft 574. When the screw shaft 574 rotates, the engaging member 577 moves in the x direction and in the opposite direction as illustrated in FIG. 10B.

When the engaging member 577 moves, an engagement surface 577*a* of the engaging member 577 engages with the engaged member 241*a*, thus discharging the sheets S. The CPU 50 can control the motor M1 to rotate backward to return the engaging member 577 from the discharging position (FIG. 10B) to the initial position (FIG. 10A).

The third exemplary embodiment, which uses a screw shaft configuration having less drive noise than a belt driving configuration, has the effect of reducing sound noise in addition to the advantageous effects of the exemplary embodiment.

The above first to third exemplary embodiments have been described with a configuration in which three sheet storing units are lapped over one another. However, the present invention is not limited to such a configuration. The present invention can also apply to a configuration in which, for example, two sheet storing units or four or more sheet storing units are lapped over one another.

Also, the above first to third exemplary embodiments have been described with a configuration in which the sheet storing apparatus 200 is mounted inside the image forming apparatus 100. However, the present invention is not limited to such a configuration. The present invention can also apply to a configuration in which, for example, a sheet storing apparatus may be mounted outside the image forming apparatus.

Furthermore, the above first exemplary embodiment has been described with a configuration in which, each time the discharging operation for the sheets S is completed, the engaging member 277 returns to the initial position in the z direction and then makes ready to perform a next sheet discharging operation. However, the present invention is not limited to such a configuration. The present invention can also apply to a configuration in which, for example, the engaging member 277 waits until a next sheet discharging operation is started, without returning to the initial position after the sheets has been discharged.

Also, the above first and second exemplary embodiments have been described with a configuration in which the direction in which the conveyance roller pair 204 conveys the sheet S is the same as the direction in which the contact members 233*a* move the sheet S. However, the present invention is not limited to such a configuration. The present invention can also apply to a configuration in which, for example, the contact members 233*a* move the sheet S in the direction perpendicular to the direction in which the conveyance roller pair 204 conveys the sheet S.

Furthermore, the present invention can also apply to a configuration in which the movement distance of the engaging member moved by the drive unit can be changed depending on the magnitude in size of the sheet S. For example, in a case where the sheet S is in a large size, such as A3 or A4, the movement distance of the engaging member for sheet discharging can be made small. In a case where the sheet S is in a small size, such as A5 or postcard, the movement distance of the engaging member for sheet discharging can be made large. This enables the amount of protrusion of the sheet S from the discharge port to be constant regardless of the size of the sheet S.

Also, the above first to third exemplary embodiments have been described with a case where the present invention is applied to a sheet storing apparatus for storing sheets. However, the present invention can also be applied to a sheet stacking apparatus for stacking sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-104542 filed May 16, 2013, which is hereby incorporated by reference herein in its entirety.

What is claimed is:

1. A sheet stacking apparatus for stacking a sheet, the sheet stacking apparatus comprising:

a plurality of sheet stacking units that are lapped over one another in a first direction, wherein each of the plurality of sheet stacking units includes a stacking member configured to stack a sheet thereon, a contact member configured to contact an edge of a sheet stacked on the stacking member, wherein the contact member is movable in a second direction parallel to a stacking surface of the stacking member and an engaged member is movable integrally with the contact member;

an engaging member configured to engage with any one of the plurality of engaged members;

a first moving unit configured to move the engaging member in the first direction;

a second moving unit configured to move the engaging member in the second direction; and a control unit configured to control the first moving unit and the second moving unit, wherein, in a case where the control unit selects a target sheet stacking unit from the plurality of sheet stacking units, the control unit controls the first moving unit and causes the engaging member to move to a position corresponding to a target engaged member, included in the target sheet stacking unit, in the first direction, and then the control unit controls the second moving unit to cause the engaging member to engage with the target engaged member and to cause a target contact member, included in the target sheet stacking unit, to move a sheet stacked on a target stacking member, included in the target sheet stacking unit, in the second direction.

2. The sheet stacking apparatus according to claim 1, wherein the engaging member and the target engaged member are located outside the target stacking member in a direction perpendicular to the second direction and parallel to a stacking surface of the target stacking member.

3. The sheet stacking apparatus according to claim 1, wherein the target engaged member includes a first engaged member configured to be engaged with the engaging member in a case where the control unit causes the target contact member to move the sheet in the second direction, and a second engaged member configured to be engaged with the engaging member in a case where the control unit causes the target contact member to return to an initial position thereof after moving the sheet.

4. The sheet stacking apparatus according to claim 1, wherein the target engaged member includes a first engaged member configured to be engaged with the engaging member in a case where the control unit causes the target contact member to move the sheet in the second direction, and an urging member configured to urge the first engaged member toward an initial position thereof.

5. The sheet stacking apparatus according to claim 1, wherein the second moving unit includes a drive source configured to generate a drive force, and a belt configured to be rotated by the drive force, and wherein the engaging member moves integrally with the belt.

6. The sheet stacking apparatus according to claim 1, wherein the first moving unit includes a drive source configured to generate a drive force, and a lever configured to be lifted and lowered by the drive force, and wherein the engaging member lifts and lowers integrally with the lever.

7. The sheet stacking apparatus according to claim 1, wherein the second moving unit includes a drive source configured to generate a drive force, and a screw shaft having a spiral groove and configured to be rotated by the drive force, and wherein the engaging member moves as the screw shaft is rotated.

8. The sheet stacking apparatus according to claim 1, wherein a movement distance of the engaging member moved by the second moving unit is changeable.

9. The sheet stacking apparatus according to claim 1, wherein the target contact member has a thickness that is thick enough to contact a plurality of sheets.

10. The sheet stacking apparatus according to claim 1, wherein the first direction is a vertical direction and the second direction is a horizontal direction.

11. The sheet stacking apparatus according to claim 1, wherein the second direction is parallel to the stacking surface of the stacking member and parallel to a direction in which a sheet is conveyed to the stacking member.

12. A sheet storing apparatus for storing a sheet, the sheet storing apparatus comprising:

an apparatus main body formed with an opening;

a plurality of sheet storing units that are lapped over one another in a first direction, wherein each of the plurality of sheet storing units includes a stacking member configured to stack a sheet inside the apparatus main body thereon, a contact member configured to contact an edge of a sheet stacked on the stacking member, wherein the contact member is movable in a second direction parallel to a stacking surface of the stacking member, and a contact engaged member is movable integrally with the contact member;

an engaging member configured to engage with any one of the plurality of contact engaged members;

a first moving unit configured to move the engaging member in the first direction; and a second moving unit configured to move the engaging member in the second direction, wherein, in a case where a control unit selects a target sheet storing unit from the plurality of sheet storing units, the control unit controls the first moving unit and causes the engaging member to move to a position corresponding to a target contact engaged member, included in the target sheet storing unit, in the first direction, and then the control unit controls the second moving unit to cause the engaging member to engage with the target contact engaged member and to cause a target contact member, included in the target sheet storing unit, to move a sheet stacked on a target stacking member, included in the target sheet storing unit, in the second direction and expose the sheet outside of the apparatus main body via the opening.

13. The sheet stacking apparatus according to claim 12, wherein the control unit causes the target contact member to move the sheet in the second direction and stop the sheet in an exposure state where a part of the sheet is exposed from the opening to an outside of the apparatus main body.

14. An image forming apparatus comprising:

an image forming unit configured to form an image on a sheet; and a sheet storing apparatus configured to store the sheet having the image formed thereon by the image forming unit, wherein the sheet storing apparatus includes:

a plurality of sheet storing units that are lapped over one another in a first direction, wherein each of the plurality of sheet storing units includes a stacking member configured to stack a sheet thereon, a contact member configured to contact an edge of a sheet stacked on the stacking member, wherein the contact member is movable in a second direction parallel to a stacking surface of the stacking member, and an engaged member is movable integrally with the contact member, wherein the sheet storing apparatus further includes:

an engaging member configured to engage with any one of the plurality of engaged members, a first moving unit configured to move the engaging member in the first direction, a second moving unit configured to move the engaging member in the second direction, a control unit configured to control the first moving unit and the second moving unit, wherein, in a case where the control unit selects a target sheet storing unit from the plurality of sheet storing units, the control unit controls the first moving unit and causes the engaging member to move to a position corresponding to a target engaged member, included in the target sheet storing unit, in the first direction, and then the control unit controls the second moving unit to cause the engaging member to engage with the target engaged member and to cause a target contact member, included in the target sheet storing unit, to move a sheet stacked on a target stacking member, included in the target sheet storing unit, in the second direction.

15. The image forming apparatus according to claim 14, wherein the engaging member and the target engaged member are located outside the target stacking member in a direction perpendicular to the second direction and parallel to a stacking surface of the target stacking member.

16. The image forming apparatus according to claim 14, wherein the target engaged member includes a first engaged member configured to be engaged with the engaging member in a case where the control unit causes the target contact member to move the sheet in the second direction, and a second engaged member configured to be engaged with the engaging member in a case where the control unit causes the target contact member to return to an initial position thereof after moving the sheet.

17. The image forming apparatus according to claim 14, wherein the target engaged member includes a first engaged member configured to be engaged with the engaging member in a case where the control unit causes the target contact member to move the sheet in the second direction, and an urging member configured to urge the first engaged member toward an initial position thereof.

18. The image forming apparatus according to claim 14, wherein the second moving unit includes a drive source configured to generate a drive force, and a belt configured to be rotated by the drive force, and wherein the engaging member moves integrally with the belt.

19. The image forming apparatus according to claim 14, wherein the first moving unit includes a drive source configured to generate a drive force, and a lever configured to be lifted and lowered by the drive force, and wherein the engaging member lifts and lowers integrally with the lever.

20. The image forming apparatus according to claim 14, wherein the second moving unit includes a drive source configured to generate a drive force, and a screw shaft having a spiral groove and configured to be rotated by the drive force, and wherein the engaging member moves as the screw shaft is rotated.

21. The image forming apparatus according to claim 14, wherein a movement distance of the engaging member moved by the second moving unit is changeable.

22. The image forming apparatus according to claim 14, wherein the target contact member has a thickness that is thick enough to contact a plurality of sheets.

23. The image forming apparatus according to claim 14, wherein the first direction is a vertical direction and the second direction is a horizontal direction.

24. The image forming apparatus according to claim 14, wherein the second direction is parallel to the stacking surface of the stacking member and parallel to a direction in which a sheet is conveyed to the stacking member.

25. An image forming apparatus comprising:

an apparatus main body formed with an opening;

an image forming unit configured to form an image on a sheet; and a sheet storing apparatus configured to store the sheet having the image formed thereon by the image forming unit, wherein the sheet storing apparatus includes:

a plurality of sheet storing units that are lapped over one another in a first direction, wherein each of the plurality of sheet storing units includes a stacking member configured to stack a sheet inside the apparatus main body thereon, a contact member configured to contact an edge of a sheet stacked on the stacking member, wherein the contact member is movable in a second direction parallel to a stacking surface of the stacking member, and an engaged member is movable integrally with the contact member, wherein the sheet storing apparatus further includes:

an engaging member configured to engage with any one of the plurality of engaged members, a first moving unit configured to move the engaging member in the first direction, a second moving unit configured to move the engaging member in the second direction, and a control unit configured to control the first moving unit and the second moving unit, wherein, in a case where the control unit selects a target sheet storing unit from the plurality of sheet storing units, the control unit controls the first moving unit and causes the engaging member to move to a position corresponding to a target engaged member, included in the target sheet storing unit, in the first direction, and then the control unit controls the second moving unit to cause the engaging member to engage with the target engaged member and to cause a target contact member, included in the target sheet storing unit, to move a sheet stacked on a target stacking member, included in the target sheet storing unit, in the second direction and expose the sheet outside of the apparatus main body via the opening.

26. The image forming apparatus according to claim 25, wherein the control unit causes the target contact member to move the sheet in the second direction and stop the sheet in an exposure state where a part of the sheet is exposed from the opening to an outside of the apparatus main body.

* * * * *